US005787692A

United States Patent [19]

Purdy

[11] Patent Number: 5,787,692

[45] Date of Patent: Aug. 4, 1998

[54] METHOD AND APPARATUS FOR SADDLING A HORSE

[76] Inventor: Vernon Purdy, 2400 Meadow Ranch Rd., Solvang, Calif. 93463

[21] Appl. No.: 775,140

[22] Filed: Dec. 31, 1996

[51] Int. Cl.[6] ..... B68C 1/12

[52] U.S. Cl. ..... 54/66

[58] Field of Search ..... 54/44.6, 65, 66; 5/710, 713; 297/200

[56] References Cited

U.S. PATENT DOCUMENTS

| | | | |
|---|---|---|---|
| 709,930 | 9/1902 | Rensman . | |
| 753,751 | 3/1904 | Stern | 54/44.6 |
| 770,975 | 9/1904 | Lohr . | |
| 809,276 | 1/1906 | Aulton | 54/65 |
| 3,343,338 | 9/1967 | Stubben | 54/66 X |
| 4,136,506 | 1/1979 | Miller | 54/66 |
| 5,027,589 | 7/1991 | Gleb et al. | 54/66 |
| 5,548,948 | 8/1996 | Smith et al. | 54/66 |

*Primary Examiner*—Robert P. Swiatek
*Attorney, Agent, or Firm*—Leo F. Costello

[57] ABSTRACT

A method and apparatus for accommodating a saddle on the back of a horse whose anatomy does not conform to the shape of the saddle in that the lengths of its leg bones are different causing its scapulae to be at different heights. The apparatus includes inflatable chambers that are supported on the back of a horse under the saddle at predetermined regions over the scapula, the ribs adjacent thereto and the overlying muscles and that are independently inflatable to transfer part of the weight of the saddle and a rider from the scapula to the adjacent ribs and overlying muscles thereby to distribute the load more evenly between the scapula and adjacent ribs and muscles and also to level the saddle. The chambers have air valves accessible to the rider so that inflation of the chambers can be adjusted by a rider while in the saddle. The method involves not only the proper positioning of the chambers before mounting the horse but also the adjustment the inflation of the chambers by the rider both before and after mounting and after completing a ride.

18 Claims, 7 Drawing Sheets

METHOD AND APPARATUS FOR SADDLING A HORSE

BACKGROUND

Saddles are designed and manufactured to fit a generic or ideal shape of a horse's back and thus are a compromise intended to be used on a variety of horses. It is, of course, impossible or impractical to mass produce one saddle that will perfectly fit the musculo-skeletal configuration of every horse. As a result, the conventional saddle-to-horse interface is often less than ideal. The saddle is a rigid structure, and thus a one-size-fits-all saddle may result in discomfort for the rider as well as the horse. More significantly, an ill-fitting saddle may decrease the athletic performances of the horse and rider and, even worse, may lead to injury of both the horse and the rider.

In an effort to alleviate the problem of a poorly fitting saddle, it has been the common practice for many years to place a blanket, pad, or cushion on the horse's back under the saddle. These have generally been made of cloth, fiber or foam. Such devices help to reduce soreness and chafing of the horse's back, but they fail to address the real problem of conflict between the rigid saddle and a particular horse's anatomy. The U.S. Pat. Nos. 809,276 to Aulton and No. 3,343,338 to Stubben propose pneumatic saddle cushions, but these cushions fail to recognize the fundamental problems of dealing with a horse's anatomy. As a result, these patented cushions are not known to have been commercially successful.

No padding is known that takes into consideration the varying shapes of horses' backs, the asymmetry of musculo-skeletal form, or the proper distribution of weight of rider and saddle in order to allow for true freedom of movement of the horse. A simple blanket or pad, or air cushions of the types noted above, fail to recognize the need to accommodate the saddle to particular aspects of a horse's anatomy since how well a saddle fits depends on the musculo-skeletal structure of the horse. In analyzing why a saddle does not fit well on a horse's back, therefore, it is necessary to analyze this musculo-skeletal structure and to make corresponding adjustments in the way the saddle is supported on the horse's back.

Thus, in analyzing the anatomy of a horse, it would seem that the scapula or shoulders of a horse should be level, that is, at the same height, but research shows that they are usually not level. The scapulae differ in height because the lengths of the leg bones are commonly different, causing the scapula of the shorter leg to be lower than the scapula of the longer leg. In turn, these differences cause the spine to twist and the rib cage to dip down at the front and thus the horse's back to dip down on one side and toward the front out of an ideal level position, having a similar effect on the saddle. These leg differences may cause the scapulae to adjust their natural positions in an effort to maintain the top of the scapulae at the same height and the spine in its naturally straight position, but such adjustments do not place the saddle in a level position. Such leg differences also cause differences in stride and other actions that result in changes in musculature, with the shorter leg having a weakened development of muscle.

The pneumatic cushions of the above-cited patents fail to solve the described misfit of a saddle on a horse because they do not recognize the need to apply significant differential pressure on particular parts of the anatomy of the horse and minimal uniform pressure on other parts. The structure of the Stubben cushion is specifically designed to create a flattened shape and an essentially uniform pressure throughout and is thus incapable of adjusting its configuration to the asymmetry of the multitude of shapes of horses backs. Stubben merely substitutes air as a cushioning medium rather than cloth, fiber or foam.

Although Aulton refers to applying pressure on particular spots, or removing such pressure from sore spots, Aulton does not address the problem of distributing the weight from the places where the saddle is normally borne to adjacent parts of the horse's anatomy, nor does it specifically recognize the anatomical deficiencies noted above that are exacerbated by a saddle. Moreover, Aulton's construction does not facilitate application of pressure on the most desirable places of the horse.

SUMMARY

A method and apparatus is provided for accommodating a saddle on the back of a horse whose anatomy does not conform to the shape of the saddle in that the lengths of its leg bones are different causing its scapulae to be at different heights. The apparatus includes inflatable chambers that are supported on the back of a horse under the saddle at predetermined regions over the scapula, the ribs adjacent thereto and the overlying muscles and that are independently inflatable to transfer part of the weight of the saddle and a rider from the scapula to the adjacent ribs and overlying muscles thereby to distribute the load more evenly between the scapula and adjacent ribs and muscles and also to level the saddle. The chambers have air valves accessible to the rider so that inflation of the chambers can be adjusted by a rider while in the saddle. The method involves not only the proper positioning of the chambers before mounting the horse but also the adjustment the inflation of the chambers by the rider both before and after mounting and after completing a ride.

An object of this invention is to provide a method and apparatus for distributing and balancing the weight of a saddle and rider on the back of a horse.

Another object is to improve the fit of a saddle on a horse.

A further object is to reduce undesirable pressure points and the resulting muscle atrophy caused by a saddle on the back of a horse.

An additional object is to help a saddled horse have a greater range of motion for its front legs and increased horizontal, lateral movement of its spine that bears the weight of the saddle.

Yet another object is to provide greater comfort for the muscles of a horse under the saddle on its back and to create a more secure fit for the saddle by reducing stress at the pressure points.

A still further object is to cause a saddle to rest evenly balanced on a horse thereby giving the rider a greater sense of security and personal balance while riding the horse.

Yet another object is to allow both a horse and rider to increase their athletic performance and to lessen the risk of injury to both even though the horse may have an anatomy that is not symmetrical.

An additional object is to position a saddle on a horse's back in a place that it would be if the horse's back were level and symmetrical even though it is not.

Another object is to support and balance a saddle on a horse so as to compensate for the fact that one of the horse's legs is shorter than the other resulting in the scapulae being at different heights and causing the saddle to tilt down and forwardly on one side of the horse.

Still another object is simultaneously to elevate and level the saddle and apply pressure over both the trapezius and latissimus dorsi muscles that overlie the lower scapula and rib cage of a horse in order to transfer part of the weight of the saddle and rider from such trapezius muscles and scapula to the latissimus dorsi muscles and the rib cage so that such weight is shared by all of said muscles and bone structure instead of being borne primarily by the trapezius muscles and scapula.

A further object is to relieve the pressure on the lower scapula of horse whose scapula are at different heights thereby allowing both scapulae and front legs to have a greater range of motion.

Yet a further object is to apply pressure as needed on the back and loins of a saddled horse at the normal pressure points of the saddle against the longissimus dorsi muscles that overlie the rib cage, the spine and the tuber coxae and pelvic bones.

An additional object is to enable a rider while in the saddle, and even while riding, to level the saddle and to adjust the pressure distribution of the weight of the saddle and the rider on the horse.

A further object is to provide an air balance saddlepad that is better able to displace saddle irregularities, muscalature imbalance and wither conformation than existing products.

Still another object is to provide an inflatable saddlepad that is constructed to be able to apply the necessary pressure to the best possible places on the back of a horse and thereby to adjust for the uniqueness of various horses' backs.

Yet another object is to provide an inflatable saddlepad that not only gives cushioning between the saddle and a horse's back but more importantly imitates the natural and correct shape of the back, creating the best solution available to strengthen and free the use of muscles and bones under and around the saddle.

These and other objects and advantages of the invention will become apparent upon reference to the accompanying drawings and the following detailed description.

DETAILED DESCRIPTION

Figure 1:
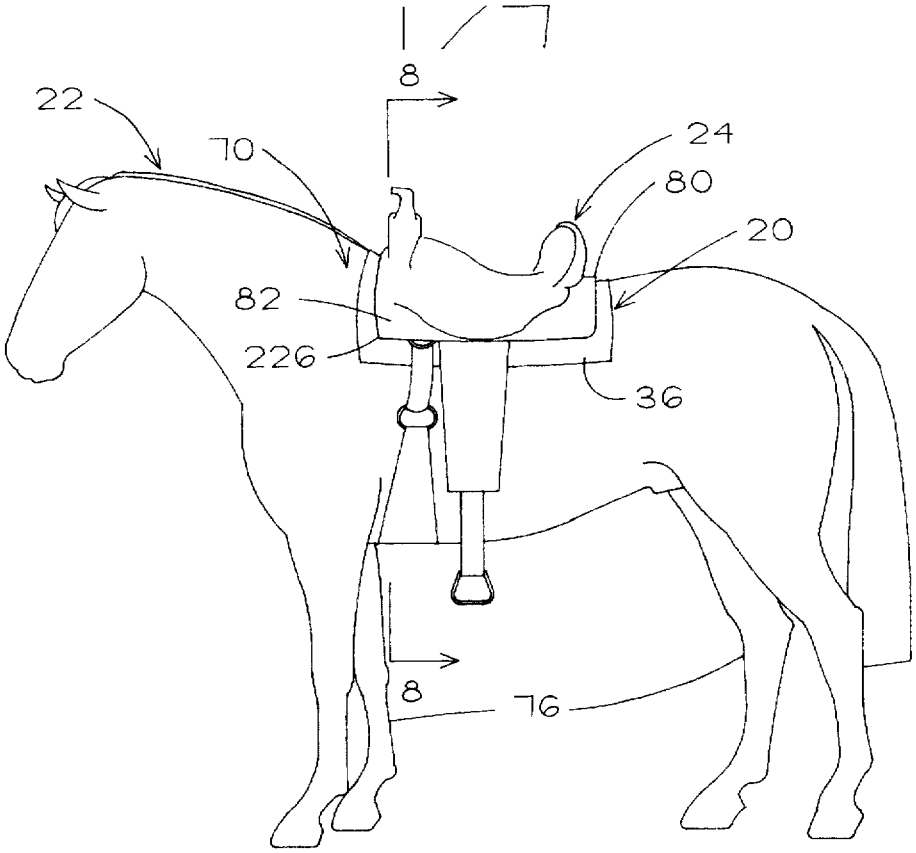
FIG. 1 is a side elevation of a horse on which is placed a saddlepad constructed in accordance with the present invention and shown under a Western saddle on the horse.
Figure 2:
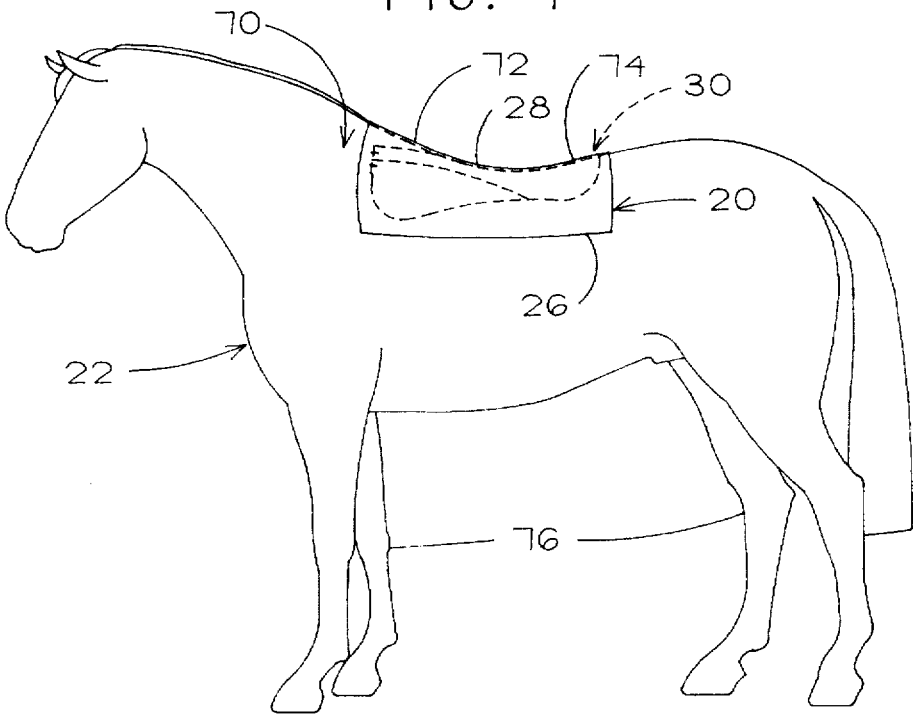
FIG. 2 is also a side elevation of a horse similar to FIG. 1 except with the saddle removed in order to show the saddlepad including a blanket and an inflatable envelope in dashed lines within the blanket.
Figure 9:
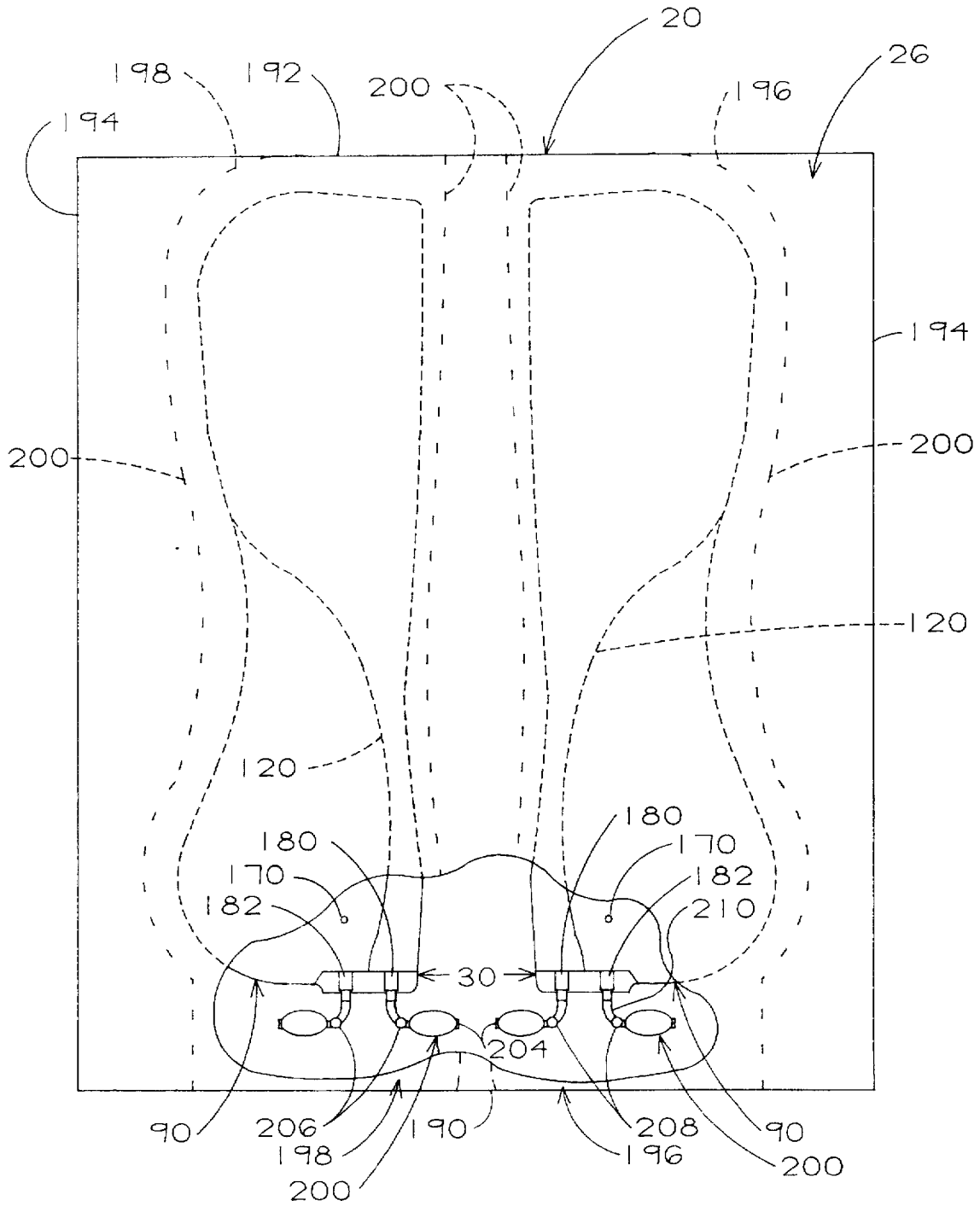
FIG. 9 is a plan view of the saddlepad of the present invention with parts broken away to show the two inflatable envelopes in the blanket and with the rest of the envelopes in dashed lines.
Figure 10:
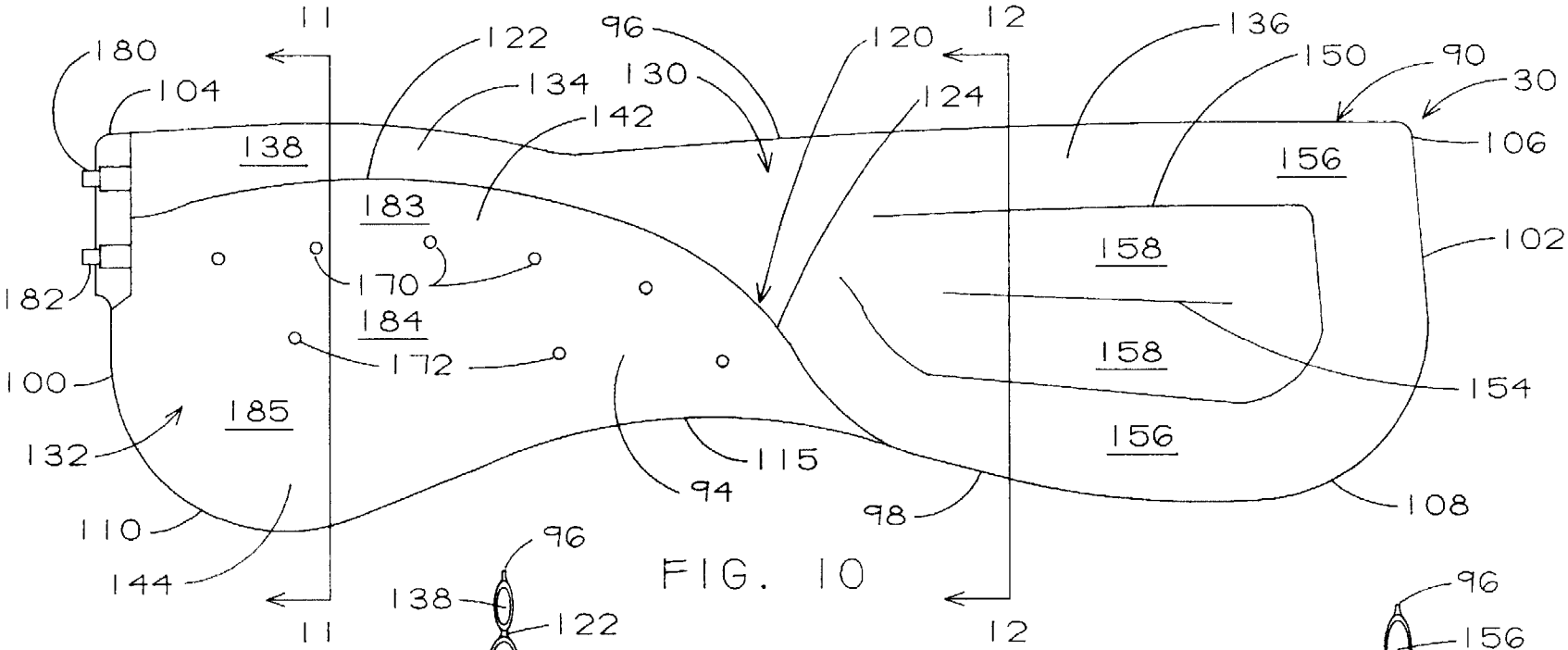
FIG. 10 is an enlarged side elevation of one of the inflatable envelopes of the subject saddlepad with the envelope deflated and in flat condition.

With reference to FIGS. 1, 2, and 9, a saddlepad made in accordance with the present invention is identified by the numeral 20 and is shown on a horse 22 under a Western saddle 24 on the horse. The saddlepad includes a rectangular blanket 26 placed over the horse's back 28 in the usual way. The saddlepad differs, however, in that a pair of airbags 30 is supported in and by the blanket on opposite sides of the horse (FIG. 10). Prior to describing the details of the method and apparatus (that is, the saddlepad) of the present invention, it will be helpful to provide a brief reference to those parts of the anatomy of a horse, and to changes in such anatomy, that are especially involved in and affected by using the apparatus and carrying out the method of the invention.

Thus, FIGS. 3 through 7 are partial skeletal and musculature side elevations of the left side of the horse 22. Reference in FIGS. 3 through 7 is made to one side of the horse only, so that the parts referred to are duplicated on the right side of the horse, not shown in FIGS. 3 through 7. It is to be understood that as used herein, the relationships of "left" and "right" are changes in a particular horse's anatomy, however, cause an asymmetry, particularly in the skeletal relationship of the bones, that is compensated for by the present invention.

Figure 3:
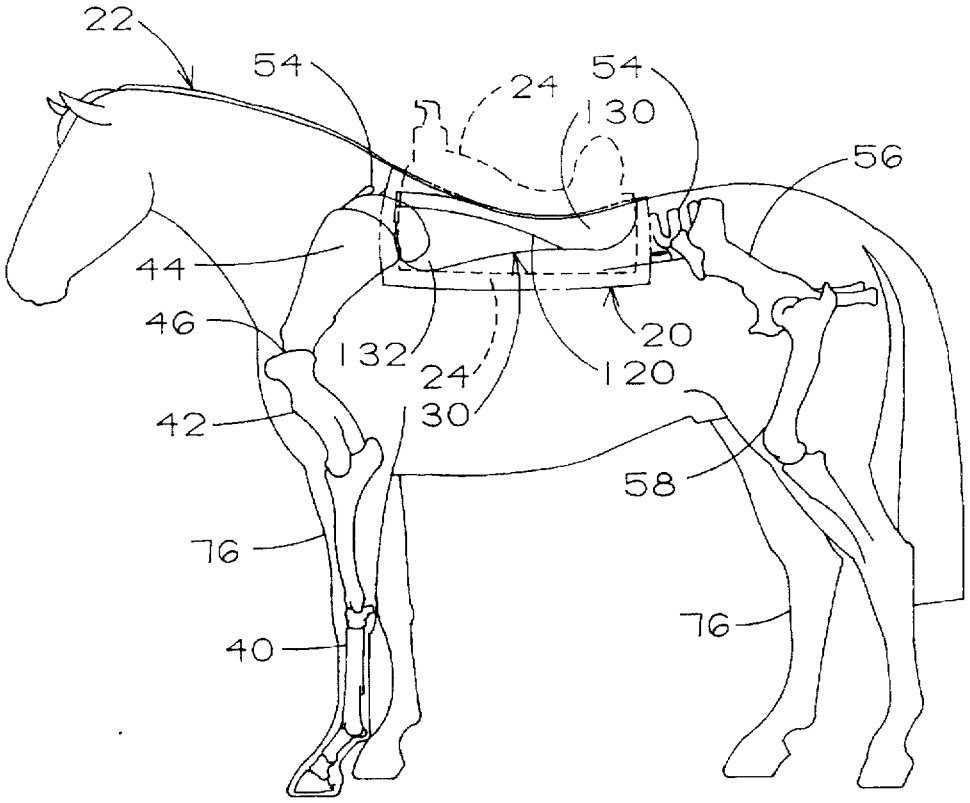
FIG. 3 is a side elevation showing part of the skeletal structure of the horse with the subject inflatable envelope shown in solid lines and its enclosing blanket shown in phantom lines.
Figure 5:
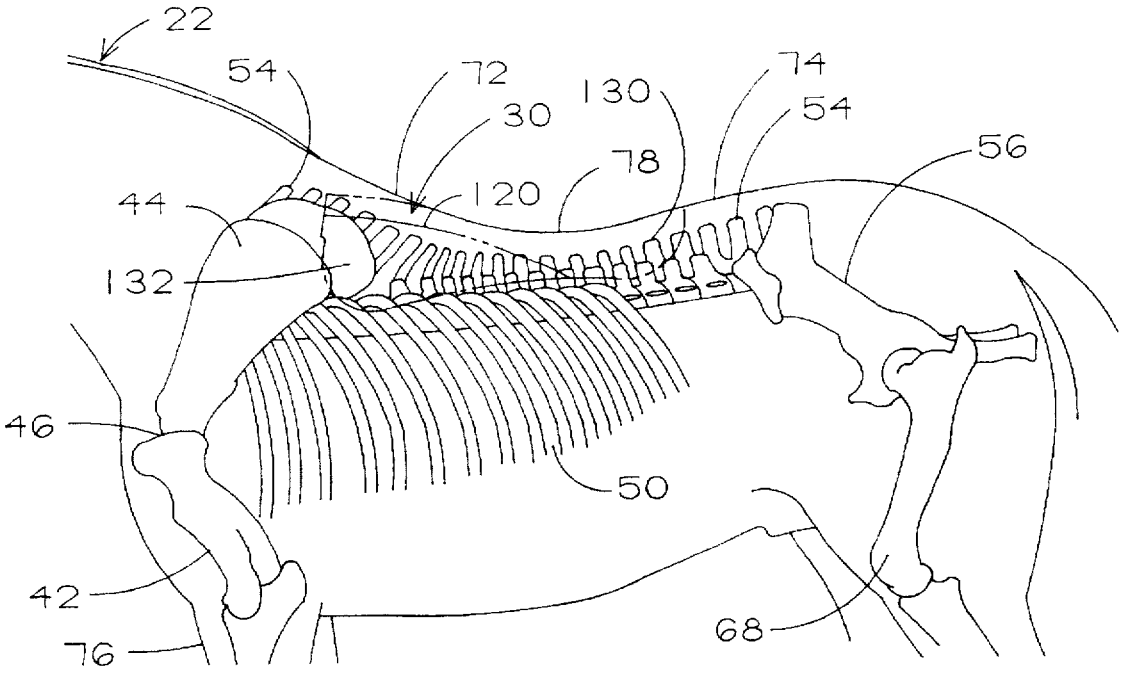
FIG. 5 is an enlarged fragmentary view of a portion of FIG. 3 and showing the saddlepad of the present invention overlying the relevant bone structure of the horse.

In FIG. 3, there is specifically identified the lower leg bones 40 of the horse 22 including the radius, the carpus or knee and the cannon; the upper leg bone or humerus 42; the scapula or shoulder 44; and the shoulder joint 46 that interconnects the scapula and the humerus. Also identified with numbers in FIG. 5 are the rib cage and ribs 50, the spine 54, the pelvic bones 56, and the rear leg bones 58.

Figure 4:
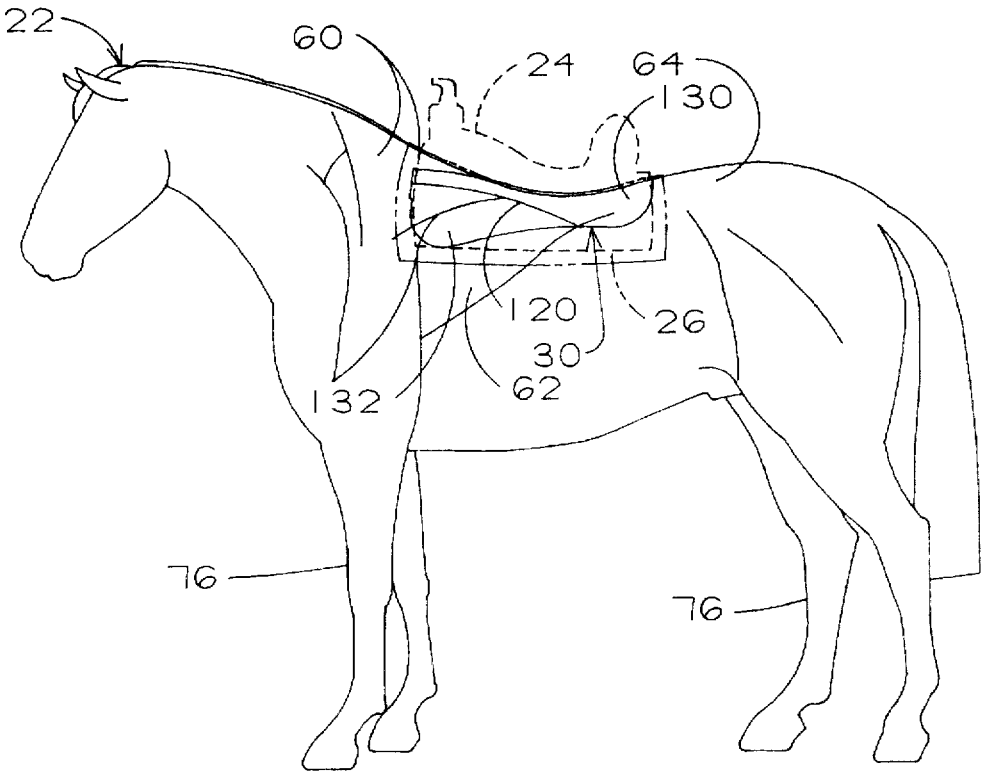
FIG. 4 is a side elevation similar to FIG. 3 but showing how the inflatable envelope relates to relevant parts of the muscular structure of a horse.
Figure 6:
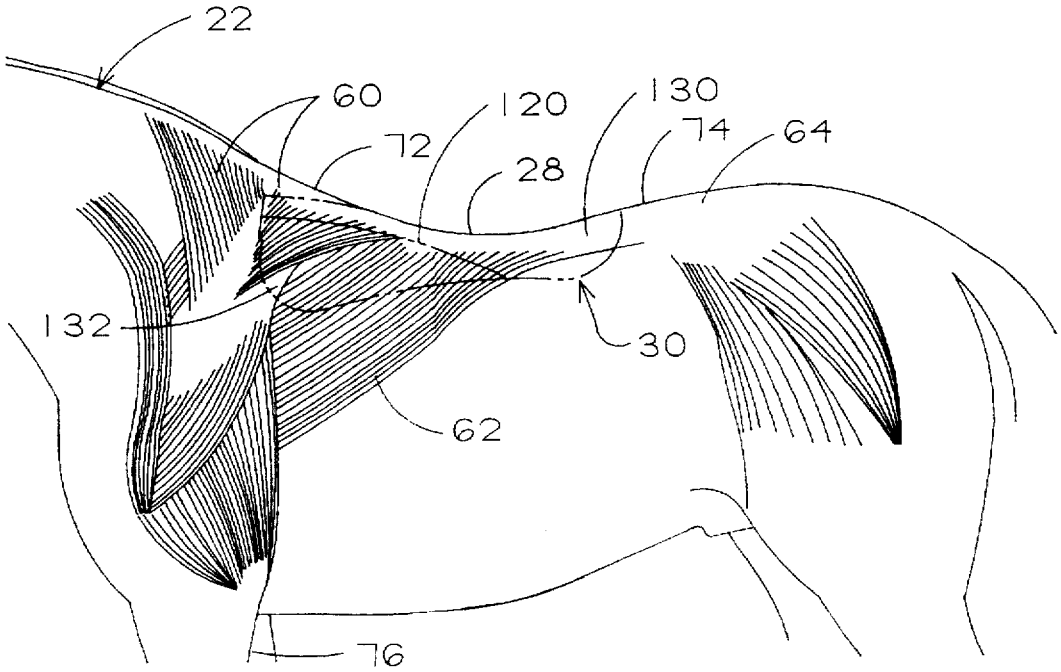
FIG. 6 is an enlarged fragmentary view of a portion of FIG. 4 and showing the saddlepad overlying the relevant muscles of the horse.

Referring to FIGS. 4 and 6, the muscles given specific numbers are the trapezius muscles 60 that overlie the scapula 44; the latissimus dorsi muscles 62 that are attached to the trapezius muscles and overlie the forward upper part of the rib cage 50 and the spine 54; and the longissimus dorsi muscles 64 that underlie the connective tissue of the other muscles and extend forwardly and rearwardly in overlying relation to the spine.

The external anatomy of the horse 22 (FIGS. 1 through 7) that is referred to in particular with regard to the present invention, in addition to the back 28, are the shoulders 70, the withers 72, the loins 74, and of course the legs 76.

Figure 7:
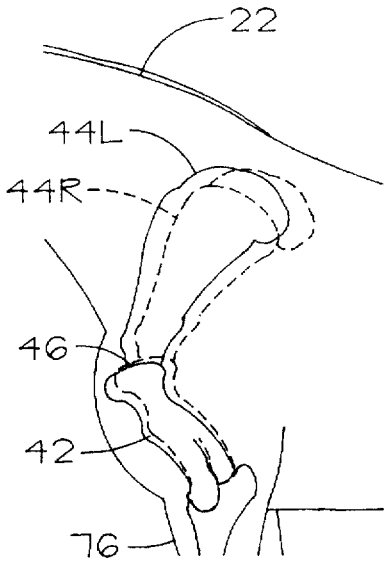
FIG. 7 is a fragmentary side elevation of a horse with hidden bones on the opposite side of the horse shown in dashed lines so as to show how the scapulae can adjust in an effort to compensate for differences in leg lengths.

Ideally, the scapulae 44 and shoulders 70 of a horse 22 (FIGS. 7 and 8) should be parallel with one another and thus level, that is, at the same height. Actually, however, one scapula is usually lower than the other, for example, the horse's left scapula in FIG. 8. Studies show that the lengths of leg bones 40, 42 on opposite sides of a horse are very commonly different, resulting in the different heights and an asymmetry in the anatomy. Under these circumstances, the scapula of the shorter bone column, for example, the horse's left scapula in FIGS. 7 and 8, may move forwardly toward, but not into, a more vertical, straight up and down position. The scapula attached to the longer leg column, however, may move rearwardly and downwardly. If these movements occur, they do so in an attempt to keep the scapula, rib cage 50 and spine 54 level; these movement tendencies are illustrated in FIG. 7. The horse's body may make these adjustment in an attempt to keep a level arrangement of body parts, but whether or not it does, various degrees of asymmetry are likely to remain. These changes in the horse's ideal bone structure cause an abnormal stride and leg use resulting in differences in the horse's muscles with a weakened development of muscle in the shorter leg. In addition and apart from the asymmetry described, the amount of muscle on a particular horse may change depending on the conditioning performed.

If a saddle, as 24 (FIGS. 1, 3, 7, and 8), is placed on a horse, as 22, that has the described asymmetrical anatomy, the rigidity of the saddle will cause its position to change accordingly. The strong side of the horse's back tends to push the saddle back whereas the weak side allows the saddle to drop down and forward. As a result, the rear portion 80 of the saddle moves too close to the spine 54 creating a curve in the spine, exaggerating stride abnormalities, and leading to a multitude of lameness. Since the front portion 82 of the saddle overlies and bears on the shoulders 70, the saddle will tilt laterally downwardly and forwardly toward the lower shoulder, that is, the lower scapula 44. The saddlepad 20 of the present invention adjusts for these irregularities to benefit both the rider and the horse, as will be seen.

Figure 12:
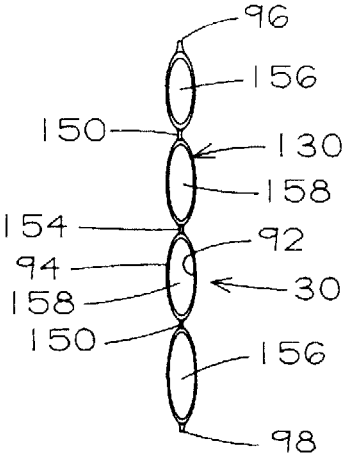
FIG. 12 is a section taken on a plane indicated by line 12—12 in FIG. 10 but with the envelope inflated.
Figure 11:
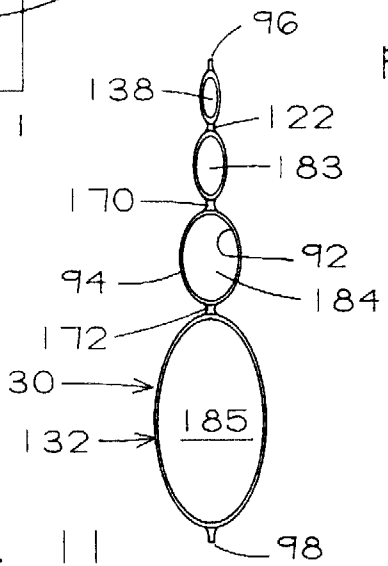
FIG. 11 is a section taken on a plane indicated by line 11—11 in FIG. 10 but with the envelope inflated.

One of the airbags 30 incorporating the principles of the present invention is shown in detail in FIGS. 10 through 12, but FIG. 2 may also be referred to show the relationship of the airbag on the horse 22. The airbag includes an elongated flexible envelope 90 or bladder preferably made of plastic such as polyethylene. The envelope has an inner wall 92, an outer wall 94, an upper edge 96, a lower edge 98, a front edge 100, and a rear edge 102. The upper, lower, front, and rear edges of the envelope of course define the periphery of the envelope along which the inner and outer walls are sealed in air-tight relation. The upper and front edges and the upper and rear edges, respectively, meet in upper front and upper rear junctures 104 and 106 which are preferably right angular or nearly so. The lower edge meets the front and rear edges in lower rear and lower front junctures 108 and 110, respectively, both of which are curved. As shown in FIG. 10, the lower front and lower rear junctures project downwardly relatively to the middle 115 of the lower edge so that the transverse dimensions of the envelope at its front and rear adjacent to section lines 6—6 and 7—7 are greater than the transverse dimension at the middle 115.

Although the invention is not limited to any particular dimensions, it may be helpful in understanding the invention to provide the dimensions of the preferred embodiment. Accordingly, for a Western saddle, as 24, the envelope 90 is approximately thirty inches long in its maximum dimension as measured between the front and rear edges 100 and 102 along the upper edge 96; approximately seven and one-half inches wide between the upper and lower edges 96 and 98 at its maximum transverse dimension adjacent to the front edge 100; and approximately five inches wide between the upper and lower edges at its maximum transverse dimension adjacent to the rear edge 102. In addition, when completely deflated, the distance between the outside surfaces of the inner and outer walls 92 and 94 is approximately one-sixteenth of an inch.

The envelope 90 (FIGS. 2 and 10 through 12) includes an elongated seam 120 which joins the inner and outer walls 92 and 94 in air-tight relationship along the seam. The seam starts at the front edge 100 in downwardly adjacent spaced relation to the upper edge 96, extends in generally parallel relationship to the upper edge along a longitudinal segment 122 to approximately the middle 115 of the envelope and then curves downwardly in a generally S-shaped transverse segment 124 that terminates in the lower edge 98. This seam thus separates the envelope into an upper air chamber 130 and a lower forward chamber 132. The upper chamber includes a front neck or section 134 extending from the front edge 100 along the upper edge 96 and longitudinal segment 122 of the seam and a rear enlarged section 136 partially defined by the lower edge 98, the rear edge 102, and the upper edge 96. The neck thus provides a narrow front passageway 138 that terminates at the front edge, extends rearwardly, and opens into the enlarged rear section of the upper chamber. The lower chamber has an upper section 142 that is contiguous to the neck 134 and the rear section 136 of the upper chamber and a lower corner section 144. It will of course be evident that both the upper and lower chambers are inflatable in a manner to be described.

With continued reference to FIGS. 2 and 10 through 12, an outside U-shaped line weld 150 interconnects the inner and outer walls 92 and 94 along the line in the rear section 136 of the upper chamber 130. The outside line weld is generally parallel to the upper, rear, and lower edges defining the rear section 136 and the transverse segment 124 of the seam 120. In addition, there is a straight inside line weld 154 joining the inner and outer walls, located within the outside line weld and intersecting the approximate center of the rear section of the upper chamber. These welds define rear passageways 156 and 158, each of which is slightly wider than the width of the front passageway 138. As shown in FIG. 7, the front passageway 138 feeds into the forward open ends of the rear passageways. The purpose of the line welds is to create relatively uniform inflation in the front and rear passageways. It is to be understood that the number of outside line welds may be varied if desired to create more passageways. The purpose of those welds and the narrow neck is to establish relatively inform inflation over the entire upper chamber 130. Such uniform inflation could be created by a plurality of spot welds, approximately spaced, but line welds are preferred.

Furthermore, and again referring to FIGS. 2 and 10 through 12, a row of upper spot welds 170 interconnect the inner and outer walls 92 and 94 in the lower forward chamber 132. This row of spot welds runs generally parallel to the seam 120 and is spaced from the seam at approximately one inch in the preferred embodiment. A pair of lower spot welds 172 also interconnects the inner and outer walls. Each of the lower spot welds is spaced downwardly from the upper row of spot welds, preferably by a distance slightly greater than one inch in the preferred embodiment. The purpose of the spot welds, and in particular their location and spacing, is to create a differential inflation in the lower chamber 132, as will be seen.

The airbag 30 (FIGS. 2, 9 and 10) also includes upper and lower one-way air valves 180 and 182 secured to the envelope 90 and respectively communicating with the upper and lower chambers 130 and 132. Thus, the upper and lower chambers can be independently inflated through the air valves. Insofar as the upper chamber is concerned, narrow neck 134 and the welds 150 and 154 control the degree of inflation of the upper chamber. As more air is added, the passageways 138, 156, and 158 expand (FIG. 12) but only to a limited degree. Moreover, because the passageways are all of approximately the same width, the amount of inflation is approximately the same over the entire upper chamber.

Also, in the lower chamber 132 (FIGS. 2, 9 and 10), the spot welds 170, 172 likewise control the degree of inflation, but here, the spot welds divide the lower chamber into generally three areas 184, 186, and 188, as best shown in FIG. 10. The area 184 between the upper welds 170 and the seam 120 inflates to a minimum amount slightly greater than the inflation in passageway 138, the area 186 between the upper welds and the lower welds 172 inflates to an intermediate amount, and the area 188 between the lower welds and the lower front juncture 120 inflates to a maximum width amount, all as shown in FIG. 11.

The blanket 26 of the saddlepad 20 (FIGS. 1, 2, and 9) has a front edge 190, a rear edge 192, opposite side or lower edges 194, and a pair of transversely spaced, longitudinally extending pockets 196 and 198. These pockets are closed at the rear edge of the blanket and open through the front edge. The pockets are spaced from each other by a distance such that when the blanket is placed on the horse 22, the front openings of the pockets are adjacent to the shoulders 70 of the horse. The envelopes 90 are individually slidably fitted in the pockets of the blanket so that they are completely concealed within the blanket. The upper edges 96 of the envelopes 90 are in opposed transversely spaced relation to each other, the lower front chambers 132 extend outwardly adjacent to the lower edges of the blanket, and the rear edges 102 of the envelope are adjacent to the rear edge of the blanket. In addition, the air valves 180 and 182 are disposed adjacent to the front edge of the blanket.

A pump or pumps 200 (FIG. 9) are provided for inflating the envelopes 90. Preferably, the saddlepad 20 includes four such pumps individually attached to the upper and lower air valves 180 and 182 and conveniently disposed within the pockets 196 and 198 adjacent to the front edge of the blanket 26. As such, each pump includes a squeezable bulb 202 having a one-way inlet valve 204, a barbed outlet 205, and an air-release valve 206 connected to the outlet and provided with a rotatable threaded control knob 208. The barbed outlet of each pump is slidably frictionally fitted in one end of a connector tube 210 whose other end is connected to one of the air valves 180 and 182. These pumps are of the same general construction and operate on the same principle as the pumps used to inflate a blood pressure cuff. Alternatively, only one such pump can be used releasably to connect to and inflate all four air valves 180 and 182. The single pump may be attached to one air valve carried separately in a saddlebag, or otherwise.

DESCRIPTION OF OPERATION AND METHOD

In use, the blanket 26 and the envelopes 90 are assembled as described above and shown in FIG. 9 to form the saddlepad 20. In saddling the horse 22, the saddlepad is placed over the horse's back 28 (FIG. 2) with the blanket located in the usual way so that it covers the horse from over the shoulders 70 intermediate the trapezius muscles 60 and over the latissimus dorsi muscles 62 and longissimus dorsi muscles 64 to just forward of the pelvic bone 56. Because of the locations of the envelopes 90 within the blanket, such positioning of the blanket on the horse locates the upper edges 96 of the envelopes on opposite sides of the horse's spine 54 and slightly above the rib cage 50. Because the horse's back tends to flatten as it extends rearwardly from the shoulders toward the pelvic area, the envelopes twist longitudinally, somewhat to conform to this contour so that the rear section 136 of the upper chamber 130 lies at a more flat angle than the lower chamber 132. It is here noted that the envelopes are not attached to each other nor to the saddle 24 so that within the flexible blanket, they readily s conform to the horse's back.

It is very significant, however, that this positioning of the blanket 26 and the envelopes 90 locates the lower air chambers 132 of the envelopes in overlying relation to the trapezius and latissimus dorsi muscles 60 and 62 (FIG. 6) on their respective sides of the horse 22 which in turn overlie the scapulae 44 and forward part of the rib cage 50 (FIG. 5). Also important, but to a lesser extent, is the fact that the rear sections 136 of the upper air chamber 130 are located over the rear portion of the rib cage just forwardly of the pelvic bone 56.

After the saddlepad 20 has been placed on the horse 22 (FIGS. 1, 3, 4, and 8) in the manner described and shown, the saddle 24 is placed on the horse over the saddlepad and is cinched to the horse in the usual manner. As previously noted, the front portions 82 of the saddle overlie the lower air chambers 132 of the envelope 90, and the rear portions 80 of the saddle overlie the rear sections 136 of the upper air chambers 130.

Figure 8:
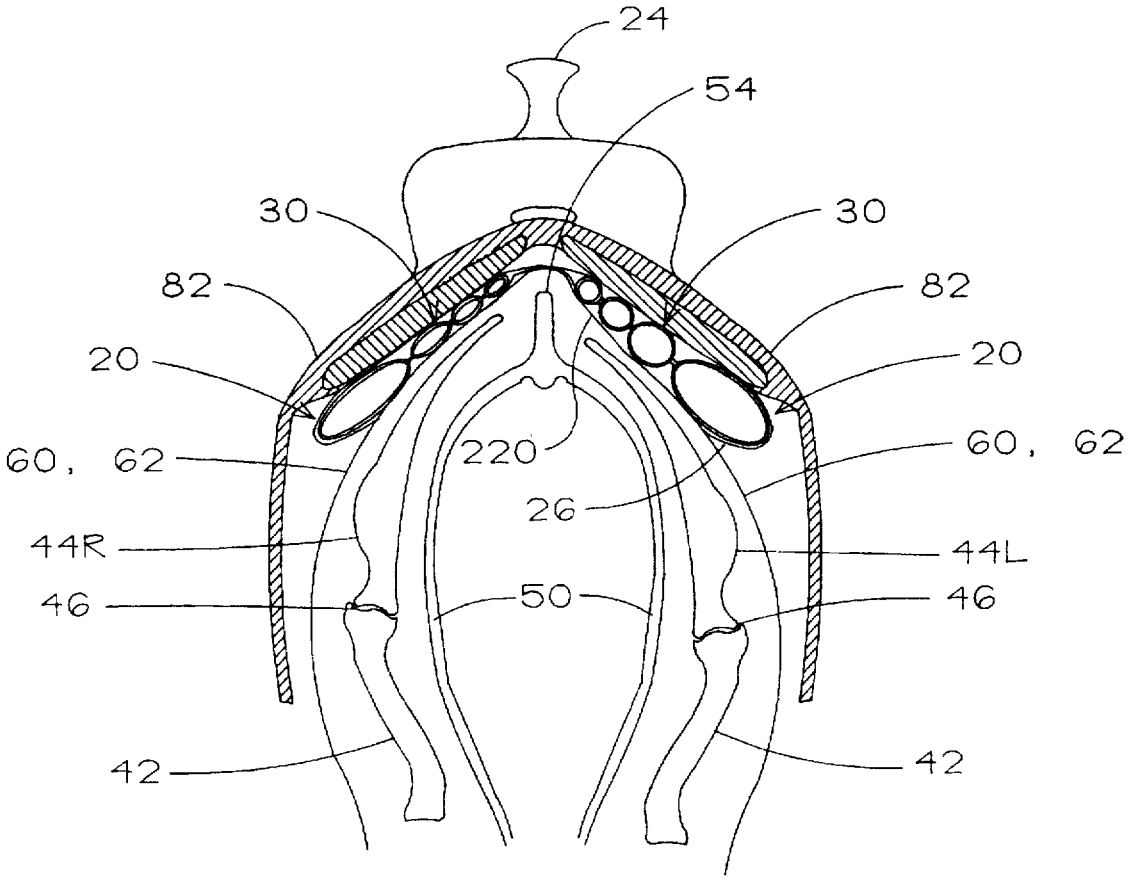
FIG. 8 is an enlarged transverse section taken on line 8—8 in FIG. 1 and illustrates the lift given to the left side of the saddle because of the lower left scapulae.

The rider then mounts the horse 22 in the conventional way and sits in the saddle 24. Assuming the horse (FIGS. 1, 2, and 10) has the asymmetrical anatomy described above, the rider will probably realize that he or she is not seated in a level position because the saddle will tilt down and forwardly to one side or the other. If so, the rider introduces air through the lower air valve or valves 182 by squeezing the bulb 202 of the appropriate pumps 200 to inflate one or both of the lower chambers 132 on one or both sides of the horse 22. For the purpose of this description, it will be assumed that the left scapula 44 of the horse is lower than its right scapula and therefore the inflation of the left lower chamber will be greater than the inflation in the right lower chamber, as illustrated in FIG. 8.

Such inflation causes the saddle 24 to be elevated thereby relieving the pressure that the saddle would otherwise cause on the trapezius muscles 60 and the scapula and transferring part of this pressure to the latissimus dorsi muscles 62 and the underlying rib cage 50. Also, such inflation relieves some of the pressure of the saddle on the spine 54 and the longissimus dorsi muscles. As a result, the saddle will move from a downwardly forwardly tilted position into a level position on the horse 22.

Air is also delivered through the upper air valve or valves 181 to the upper air chambers in the envelopes 90 on one or both sides of the horse 22. The rider also conveniently accomplishes this by squeezing the bulbs 202 of the appropriate pumps 200 for the upper air chambers 130. Here, the object is to provide more of a uniform cushion between the saddle and the horse over the flatter rear part of the horse's back, although inflation of the upper chamber also aids in achieving proper weight distribution and balance.

The amount of air added to the upper or lower chamber 130 and 132 will depend on a number of variables such as the degree of asymmetry of the horse and the weight of the saddle and rider. The air pressure will likewise vary according to the weight borne, but it is found to be in the order of three to five p.s.i. Air can be added immediately on mounting the horse or after riding awhile and can of course be subsequently adjusted. Moreover, air can be released as necessary while riding and after completing the ride.

The horse 22 is benefited because it allows the horse's legs 76 and spine 54 to have a greater range of motion and because it reduces soreness, lameness and other discomforts. The rider is benefited by an increased ability to balance over the center of the horse and the saddle 24. In this regard, it will be noted in FIG. 8 that the inflated left envelope 90 fills in the depressed or sunken area 220 between the lower left, scapula 44 and the spine 54. Also, and of major significance, the differential inflation in the lower chamber 132 (FIGS. 8 and 11), with the inflation gradually increasing from lowest amount in the passageway 138 to the greatest amount in the lowermost area 185, provides the greatest lift to the saddle where it is the most effective, that is, at the outer front tip 226 of the saddle.

Figure 13:
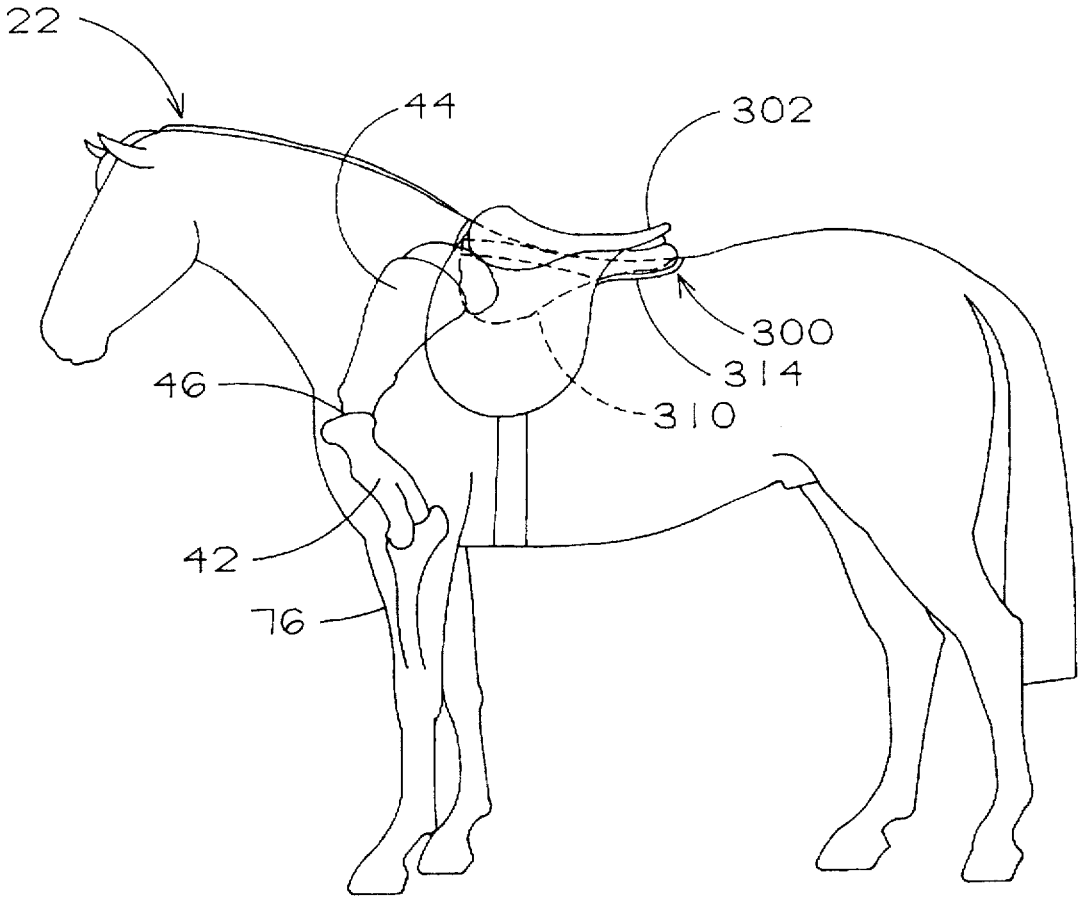
FIG. 13 is a fragmentary side elevation of a horse showing the subject saddlepad under an English saddle.

An alternative embodiment of the subject saddlepad 300 adapted for an English saddle 302 is illustrated in FIG. 13. The saddlepad 300 incorporates the same principles as the saddlepad 20 but conforms more to the shorter length of the English saddle. That is, whereas the preferred dimensions of the Western envelope 90 are given above, the envelope 310 for the saddlepad 300 has a length of about twenty-four inches (shorter than the Western envelope), a maximum width at the front of about seven and one half inches (the same as the Western saddle) and a maximum width at the rear of about four inches (and thus less than the Western embodiment). The reduced width at the rear thus allows the envelopes 310 to fit within the blanket 314 for an English saddle, which as is well known, conforms to the shape of the saddle, whereas it does not for a Western saddle. Also, for an English saddle, the pumps, as 200, are not attached to the envelopes 310 since the English saddle and blanket are not able to accommodate them in a compact manner. In other respects, the construction, use, and operation of the English saddlepad 300 is the same as described for its Western counterpart.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A load adjusting saddlepad to be positioned on the back of a horse whose leg bones are of different lengths causing its scapulae to be at different heights, the saddle being normally borne by the scapulae and overlying trapezius muscles thereby causing pressure on such scapulae and further causing the saddle to tilt downwardly toward the lower scapula, comprising:

an elongated, flexible, inflatable air bag having upper, lower, front and rear edges, inner and outer walls, and a seam extending between the front and lower edges and separating the air bag into an upper chamber having front and rear sections and a forward lower chamber that is contiguous to both of said front and rear sections of the upper chamber;

means for supporting the bag on the back of a horse under a saddle thereon so that the lower chamber overlies the trapezius and latissimus dorsi muscles that cover the lower scapula and adjacent ribs; and inflation means for individually communicating with the upper and lower chambers.

2. The saddlepad of claim 1, wherein the upper and front edges of the bag meet in an upper front corner; and wherein the inflation means is located adjacent to the upper front corner of the bag.

3. The saddlepad of claim 2, wherein the inflation means includes a first valve communicating with the front section of the upper chamber and a second valve communicating with the lower chamber, said valves being adjacent to the front edge of the bag.

4. The saddlebag of claim 2, wherein the inflation means includes an upper valve communicating with the upper chamber; and wherein the inflation means includes a lower valve communicating with the lower chamber and in side-by-side relation to the upper valve.

5. The saddlepad of claim 1, wherein the seam extends from the front edge rearwardly of the bag and then extends downwardly and meets the lower edge at a point therein closer to the rear edge than to the front edge.

6. The saddlepad of claim 1, wherein the front section of the upper chamber is an elongated narrow neck that flares rearwardly outwardly into the rear section of the upper chamber.

7. The saddlepad of claim 1, wherein the front and lower edges meet in a juncture;

wherein the lower chamber is defined by the seam, by the front and lower edges, and by the juncture; and wherein the lower chamber has means dividing it into a plurality of inflation areas between the seam and the juncture so that the inflation areas inflate in varying degrees from a minimal inflation in the inflation area closest to the seam to a maximum inflation in the inflation area closest to the juncture.

8. The saddlepad of claim 7, wherein said juncture is curved with the lower and front edges blending smoothly into the juncture.

9. The saddlepad of claim 7, wherein the dividing means includes a plurality of spaced apart rows of spot welds joining the walls together with the welds in each row spaced from each other and with the rows in spaced generally parallel to the seam.

10. The saddlepad of claim 9, wherein there are more spot welds in the row closest to the seam than there are in the row next-adjacent thereto and wherein the spot welds in the row closest to the seam are spaced closer together than in the row next-adjacent thereto.

11. The saddlepad of claim 1, wherein the upper chamber is defined by the front edge, by the upper and lower edges meeting in upper and lower rear corners of the bag, and by the seam; and wherein the rear section of the upper chamber has means dividing it into a plurality of elongated inflation passageways so that the front section and inflation passageways inflate substantially uniformly and cause substantially uniform inflation throughout the upper chamber.

12. The saddlepad of claim 11, wherein the front section of the upper chamber is an elongated narrow neck having a predetermined uniform width but rearwardly flaring at its rearward end into the rear section of the upper chamber; and wherein the dividing means includes a U-shaped line weld generally parallel to the contour of the rear section of the upper chamber and a central line weld within the U-shaped weld thereby to form said passageways.

13. The load adjusting saddlepad of claim 1, wherein there is a second elongated, flexible, inflatable air bag duplicating the first-mentioned air bag;

wherein the supporting means is adapted to support both bags on the back of a horse under a saddle thereon so that the lower chambers of the bags individually overlie the trapezius and latissimus dorsi muscles that cover the lower scapulae and adjacent ribs on opposite sides of the horse; and wherein there are inflation means for individually communicating with the upper and lower chambers of each bag.

14. A saddlepad for distributing the weight imposed by a saddle and rider on the back of a horse, comprising:

a blanket having length and width dimensions, front and rear end edges, and adapted to be placed on the back of a horse, the blanket having left and right laterally spaced, longitudinally extending pockets located on opposite sides of the horse when the blanket is on the horse, said pockets opening at the front end edge of the blanket;

elongated left and right inflatable, flexible, plastic envelopes individually slideably received in the left and right pockets, each having upper, lower, front and rear edges and a seam extending from its respective front edge in spaced relation to its upper edge longitudinally of the bag and then transversely to its lower edge and separating its envelope into upper and lower chambers, the upper chamber of each envelope having an elongated front neck and a rear section, the lower chamber of each envelope being defined by its seam and by its front and lower edges meeting in a lower front corner of its envelope, the upper chamber of each envelope being defined by its seam, by the upper and lower edges of its envelope in upper and lower rear corners thereof; and left and right rear air valves respectively communicating with the necks of the respective envelopes and located adjacent to the front edge of the blanket; and left and right front air valves respectively communicating with the lower chambers of their respective envelopes and located adjacent to the front edge of the blanket, with the front and rear valves of each envelope being adjacent to each other.

15. The saddlepad of claim 14, wherein pumps are attached to the air valves.

16. An air bag for placement on the back of a horse under a saddle thereon, comprising:

an elongated, flexible, inflatable plastic envelope having inner and outer walls, upper, lower, front and rear edges meeting in upper and lower front and rear junctures of the envelope, a longitudinal dimension between the front and rear edges, and a seam extending from the front edge in spaced relation to the upper edge longitudinally of the envelope and then transversely to the lower edge and separating the envelope into upper and lower chambers, the lower chamber being defined by the inner and outer walls, by the seam, by the front and lower edges, and by the lower front juncture, the upper chamber being defined by the inner and outer walls, by the seam, by the front, upper, lower and rear edges, and by the upper and lower rear junctures, the upper chamber having an elongated neck between the upper edge and the seam and terminating in the front edge;

a rear air valve adjacent to the front edge communicating with the neck and thus the upper chamber; and a front air valve adjacent to the rear valve communicating with the lower chamber.

17. The bag of claim 16, wherein the envelope is made of polyethylene.

18. The bag of claim 16, wherein the lower chamber has a plurality of spaced spot welds interconnecting the inner and outer walls and dividing the lower chamber into areas that inflate in varying degrees with the greatest inflation occurring adjacent to the front lower juncture; and wherein the upper chamber has a rear section back of the neck having a plurality of spaced line welds interconnecting the inner and outer walls and dividing the rear section into a plurality of passageways of approximately the same width as the neck so that the passageways and the neck inflate in substantially uniform amounts.

* * * * *